US005890880A

United States Patent [19]

Lustwerk

[11] Patent Number: 5,890,880

[45] Date of Patent: Apr. 6, 1999

[54] SEALED MOTOR DRIVEN CENTRIFUGAL FLUID PUMP

[76] Inventor: Ferdinand Lustwerk, Page Rd., Lincoln, Mass. 01773

[21] Appl. No.: 700,660

[22] Filed: Aug. 9, 1996

[51] Int. Cl.[6] ..... F04B 39/06

[52] U.S. Cl. ..... 417/366; 415/171.1; 417/423.8

[58] Field of Search ..... 417/366, 368, 417/423.7, 423.8; 415/171.1, 177

[56] References Cited

U.S. PATENT DOCUMENTS 3,507,582 4/1970 Jeep et al. ..... 417/366
5,209,635 5/1993 Stewart et al. ..... 415/171.1

*Primary Examiner*—Timothy Thorpe
*Assistant Examiner*—Cheryl J. Tyler
*Attorney, Agent, or Firm*—Robert T Dunn, Esq.

[57] ABSTRACT

A motor driven centrifugal fluid pump has the a pump rotor, and the pump drive motor both enclosed in a sealed housing that contains sealed inside the fluid that is pumped, the pump rotor being carried on the motor drive shaft so that the rotor rotates freely within the housing when driven by the motor drive shaft, a fluid input from an outside source to the housing, a fluid output to an outside utilization system from the housing and means carried on the motor drive shaft for compelling some of the fluid inside the housing to flow in heat conducting proximity to the motor to cool the motor and also reduce the thrust load on the motor.

20 Claims, 3 Drawing Sheets

VIEW C-C

VIEW B-B

VIEW A-A

VIEW D-D

VIEW E-E

SEALED MOTOR DRIVEN CENTRIFUGAL FLUID PUMP

BACKGROUND OF THE INVENTION

The present invention relates to electric motor driven centrifugal fluid pumps and particularly to pumps of the sort that have no rotating axle or bearings that penetrate a wall of the pump housing and so the housing is completely sealed against any leakage of the fluid that is pumped and there is no requirement of seals against leakage of the fluid at any moving or rotating part of the pump.

Heretofore, magnetically driven centrifugal pumps that are completely sealed up and have no drive shaft or bearing opening through any wall of the housing of the pump have been provided. Such pumps are often specified where, for any number of reasons, no fluid leakage from the pump can be tolerated and the motor power is ⅛ horsepower (HP) or less. For example: the fluid may be very contaminating; or it may be poisonous or radioactive; or it may simply be a cooling fluid in a closed system that cannot tolerate any leaks. For any of these reasons, magnetically driven pumps have been provided in which the drive from the electric motor to the rotor of the pump is by magnetic coupling through a wall of the pump housing and so there need not be any drive shaft or bearing that penetrate the wall of the pump housing and the performance is below 3 gallons per minute (gpm) at a pressure head of 30 to 50 feet (⅛ HP or less).

The fluid input of such a pump is along the axis and may be into an axial input chamber at the front inside of the housing and from that chamber into rotating radial passages that are partly defined by the impellers attached to the rotor. The fluid is trapped in these rotating radial passages between the impellers and the immediately adjacent front inside wall of the housing and is compelled to flow radially into a peripheral annular output chamber within the housing. The pressure of fluid at the input chamber is the input pressure and the pressure at the peripheral annular chamber is the output pressure and the effect of the rotation is to increase the output pressure over the input pressure even while there is a continuous flow of fluid into the input and out of the output. As volume flow increases the pressure head decreases (maximum pressure head is achieved at zero flow).

Such a pump is described in U.S. Pat. No. 4,927,336, issued May 22, 1990, entitled "Magnetically Driven Pump", to Ferdinand Lustwerk, the inventor herein. That patent describes a radial magnetically driven pump in which the pump rotor axle is supported within then sealed pump housing at only the driven end thereof; it is cantilevered from that end inside of the housing. The cantilevered pump rotor axle is preferred so that the front face of the rotor that carries the impellers has no axle between it and the opposite wall (front inside wall) of the housing as this allows a fluid input along the axis of rotation directly into the center of the impeller face of the rotor.

The impellers define radial fluid passages leading from the axial center of the front of the housing to the periphery of the housing. An axial input fluid port is at the front of the housing and an output fluid port is at the periphery of the housing. The rotor drive includes several radially oriented magnets outside of the housing magnetically coupled through the walls of the housing with the rotor magnets inside the housing. In operation, rotation of the external drive rotates the rotor causing fluid to flow from the input to the output increasing the pressure of the fluid at the output with respect to the pressure of the fluid at the input.

For electric motor driven centrifugal pumps over ⅛ HP, that are usually required to deliver more than 25 inch-ounces of torque at 5,000 revolutions per minute (RPM), the magnetic coupling has, for the above reasons, been found to be inadequate. However, for such pumps there is still the problem that the fluid pumped may be very contaminating; or it may be poisonous or radioactive; or it. may simply be a cooling fluid in a closed system that cannot tolerate any leaks. It is an object of the present invention to provide an improved electric motor driven centrifugal fluid pump wherein the fluid is an oil, the motor is an oil submersible electric motor and a sealed housing contains the fluid, the motor and the pump.

With a fluid submersible motor contained within the sealed housing with the pump as in the present invention, there is an advantage in cooling the motor by providing means for compelling the fluid to flow through parts of the motor and carry heat therefrom so that the motor can be operated at higher power without overheating. For example, a ½ HP submersible motor driving a 2 to 3 gpm pump at 30 to 50 foot high pressure head, may heat the fluid that is pumped to 280° F., which is excessive. Hence, it is another object of the present invention to provide such a pump and electric drive motor in an assembly contained within a sealed housing wherein means are provided for compelling some fluid flow around the electric motor to cool the motor while the pump is driven in operation.

With a submersible motor and centrifugal pump contained within a sealed housing and the pump fluid input at low pressure is axial at the front of the pump and the pump output at high pressure is at the periphery of the pump, the fluid pressure around the motor and between the motor and the pump rotor is at the output high pressure level. Thus, the pump rotor has a greater pressure on one side than the other and exerts a thrust load or pull on the motor drive shaft which is resisted at the motor bearings. For example, a ½ HP submersible motor driving a 2 to 3 gpm pump at 30 to 50 foot high pressure head may experience a 27 pound thrust load on the motor bearings. It is another object of the present invention to provide such a pump and electric drive motor in an assembly contained within a sealed housing wherein means are provided for compelling some fluid flow around the electric motor to reduce the static pressure on the pump rotor and so reduce the thrust load on the motor bearings.

The static pressure in a fluid is the pressure perpendicular to the direction of the fluid flow velocity. The total pressure is the static pressure plus the velocity pressure. Where there is no flow velocity, there is no velocity pressure and static pressure and total pressure are equal.

SUMMARY OF THE INVENTION

It is an object of the present invention to provide an improved electric motor driven centrifugal fluid pump wherein the pump housing contains the fluid and is sealed and there are no rotating axles or bearings through the sealed housing wall.

It is another object to provide such a pump and electric drive motor in an assembly contained within a sealed housing wherein means are provided for compelling some fluid flow around the electric motor to cool the motor while the pump is driven in operation.

It is another object to provide such a pump and electric drive motor in an assembly contained within a sealed housing wherein means are provided for reducing the thrust load exerted by the pump rotor on the electric motor while the pump is driven in operation According to the present invention, an electric motor driven centrifugal fluid pump includes a sealed housing enclosing the pump rotor and the electric motor on an axle of rotation contained within the housing and secured within the housing so that the pump rotor is cantilevered from the motor drive shaft and has shrouded (covered) main pump impellers that provide radial fluid passages leading from the axial center of the front of the housing to the periphery of the housing, an axial fluid input port is at the front of the housing and a peripheral fluid output port is at the periphery of the housing.

In a preferred embodiment, there is also provided on the pump rotor on the face thereof adjacent the electric motor, causing flow impeller vanes or ridges that drive some of the fluid radially outward between the pump rotor and the electric, motor, causing a flow of the fluid through passages between the motor and the housing and between parts of the motor such as between the motor stator and the motor rotor over the length of the motor to cool the motor.

According to another feature of the present invention, the thrust load exerted on the motor drive shaft bearings by the pump rotor is reduced by providing on the pump rotor on the face thereof adjacent the motor impeller vanes or ridges (such as the above mentioned motor cooling flow impeller vanes or ridges) that drive the fluid therebetween radially outward and so reduce the static fluid pressure between the motor and the pump rotor, even while the total pressure of the fluid around and through the motor remains relatively higher.

These and other objects and features of the present invention will be apparent to those skilled in the art from the following specific description of embodiments of the invention taken in conjunction with the drawings.

DESCRIPTION OF EMBODIMENTS OF THE INVENTION

Figure 1:
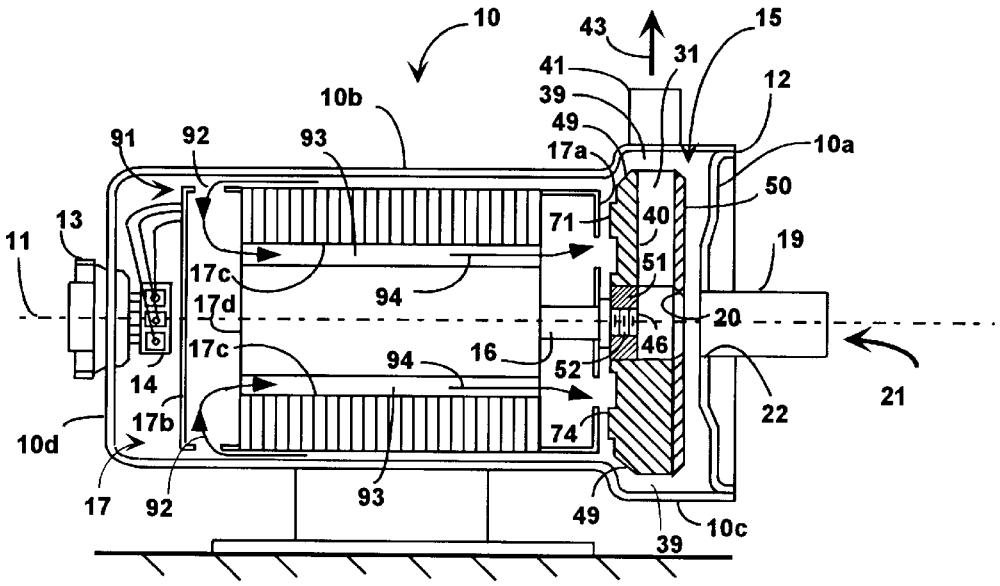
FIG. 1 is a schematic side cross section view of an electric motor driven centrifugal fluid pump according to the present invention in which the pump rotor and the electric motor are totally contained within the sealed housing which is penetrated only by the fluid input, the fluid output and the electric power leads to the motor.
Figure 3:
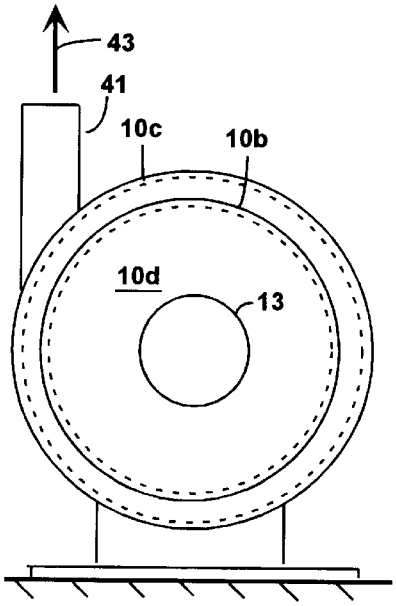
FIG. 3 is a rear end view of the pump and motor housing showing the electric power lead connector that is sealed to the housing rear wall.
Figure 2:
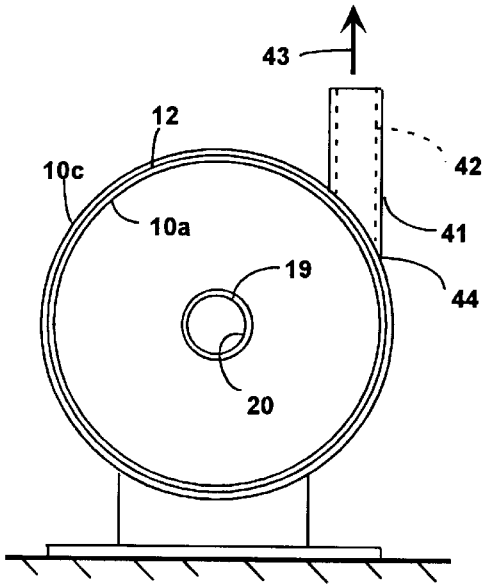
FIG. 2 is a front end view of the pump and motor housing showing the axial fluid input and the peripheral fluid output.

An electric motor driven centrifugal fluid pump that has no rotating axle or bearings that penetrate a wall of the sealed pump housing is shown in the drawings, which illustrate the preferred embodiment of the pump. The motor is entirely submersible in the fluid that is pumped in the sealed housing wherein the pump rotor is carried on the motor drive shaft. The motor is mounted to the inside of the housing, fluid input to the pump is axial at the center of the housing and fluid output from the pump is peripheral at the periphery of the housing. According to the present invention, the face of the pump rotor adjacent the motor has motor cooling fluid flow pumping vanes that drive some of the fluid within the housing to flow through the motor to cool it. This pump and drive motor assembly includes all features of the present invention and represents the best known use of the invention.

An added advantage of the motor cooling fluid pumping is that it increases the velocity of the fluid flow between the front face of the motor and the pump rotor so that the pressure of this fluid on the rear face of the pump rotor is reduced and so the pull of the pump rotor on the motor drive shaft (the thrust load) is reduced. This reduced pressure is referred to herein as the static flow pressure which is less than the total pressure as the total pressure is the static pressure plus the velocity pressure.

As shown schematically in FIG. 1, the pump and electric motor housing 10 is essentially a figure of revolution about the pump axis 11. The housing is formed in several parts, the front plate 10*a* and the cylindrical sections 10*b* and 10*c* which is closed at the back by 10*d*. Both of these parts are figures of revolution as shown in FIG. 1: cylinder 10*c* encloses the periphery of the centrifugal pump, cylinder 10*b* is a continuation of cylinder 10*c*, front plate 10*a* closes the front of cylinder 10*c* and rear end 10*d* closes the rear end of cylinder 10*b* and is a unitary part thereof. Front housing plate boa and pump housing cylinder 10*c* attach together at their peripheries at 12 by, for example, a seam of weld and so form the complete sealed housing.

Housing cylinder 10*b* closed at the back by 10*d* is herein called the motor housing cylinder and the motor 17 is mounted within that cylinder with a fluid passage 91 between the outside of the motor and the inside of that cylinder and within the motor is flow passage 93. These fluid flow passages may be annular and each extend the length of the motor as shown.

At the rear of motor housing cylinder 10*b*, in the closed back 10*d*, is mounted electrical connector 13 that is sealed thereto. This connector provides electrical connections to the motor electric power terminals 14 within the housing.

Contained within the housing is the pump rotor 15 carried on the motor drive shaft 16 which is securely attached thereto by the threaded end 46 of the drive shaft, which engages the threads 52 of hex nut 51 that is fixedly embedded in the pump rotor base 49.

The axial fluid input passage 20 is provided by fluid input tube 19 that projects through an input hole 22 in the front housing plate 10*a* and is sealed to the housing plate at 22 by, for example, a weld seam.

The main fluid flow impeller vanes of the pump rotor 15 (see FIGS. 4 to 7) are radially oriented main vanes 31 to 36 on the face 40 of the rotor base 49 and may be an integral unitary part of the rotor base. These main impeller vanes are of uniform height and equally angularly spaced about the rotor base face 40 and define radial expanding passages 61 to 66 that lead from the axial chamber 415 inside the rotor to the annular peripheral chamber 39 within the pump housing from which the fluid output passage 42 leads. The fluid output passage 42 may be, for example, a short length of tubing 41 leading tangentially from annular chamber 39 and sealed to the housing by a weld seam at 44.

Input fluid flow to the pump through input tube 19 is indicated by double line arrow 21. Output fluid flow from the pump through output tube 41 is indicated by double line arrow 43. The pump rotor 15 is shown in several views by FIGS. 4 to 7. The main impeller vanes, as mentioned above define expanding radial passages 61 to 66 which are entirely formed within the rotor. They are formed by the vanes 31 to 36, face 40 of the rotor base 49 and the rotor cover plate 50. FIG. 6 shows face 40 of the rotor base 49 and impeller vanes 31 to 36 with cover plate 50 removed. Clearly, the main radial passages 61 to 66 are each defined by two of the main vanes and the passages are radially expanding.

Figure 4:
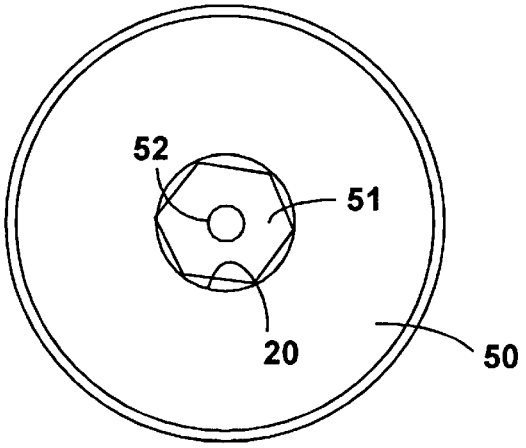
FIG. 4 is a front view of the rotor showing the main fluid impeller vanes shroud plate, (motor cover plate) fluid input central flow opening into the pump rotor and embedded hex nut for connecting (mounting) the pump rotor to the motor drive shaft.
Figure 5:
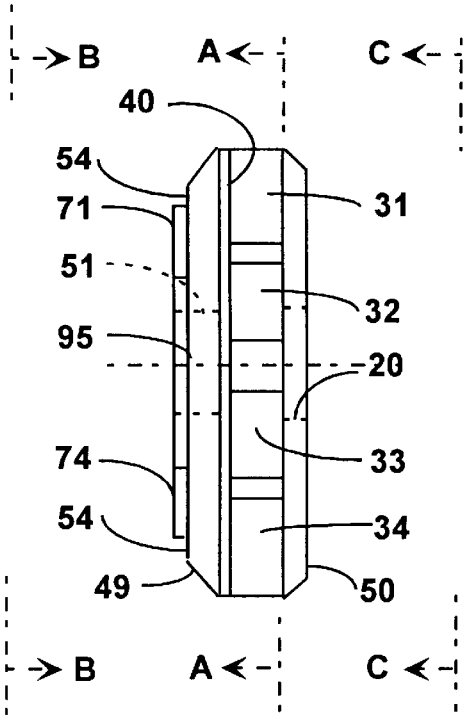
FIG. 5 is a side view of the rotor showing the main fluid impellers vanes, shroud plate and the rotor base which define the shrouded main radial fluid passages and motor cooling flow impeller vanes or ridges on the; side of the base that faces the motor for compelling some of the fluid to flow around the motor to cool the motor.
Figure 6:
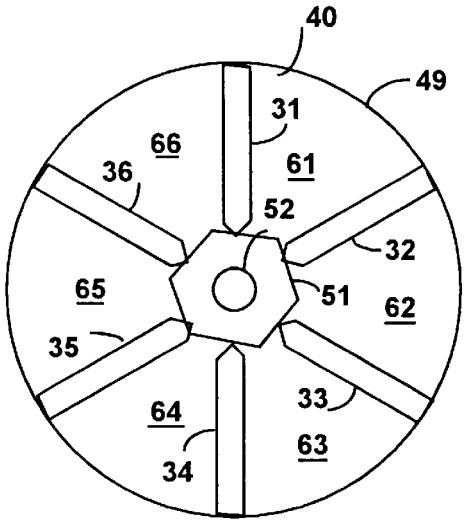
FIG. 6 is a cut away view of the rotor from the front with the cover plate removed showing the orientation of the main impeller vanes and the main radial centrifugal flow passages they define.

When the cover plate 50 is affixed to the main vanes as shown in FIGS. 4 and 5, passages 61 to 66 are each totally enclosed or shrouded and contained in the rotor and so the fluid that flows through those passages does not flow also against the stationary front inside wall of the housing front plate 10*a* and so is not: subject to the friction losses of such flow.

Figure 7:
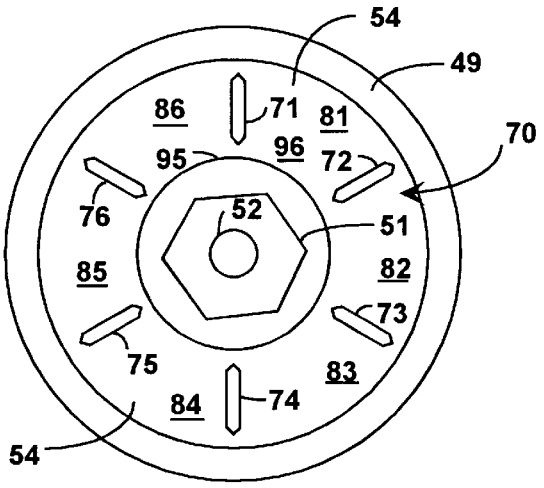
FIG. 7 is a rear view of the pump rotor showing imbedded hex nut for mounting to the motor drive shaft and the rear face of the rotor base that carries the motor cooling fluid flow radial vanes or (ridges) and central raised disc shaped portion, which together with the immediately adjacent front of the motor define the radial motor cooling fluid flow centrifugal flow passages that pump some of the cooling fluid around parts of the motor to cool the motor.
Figure 8:
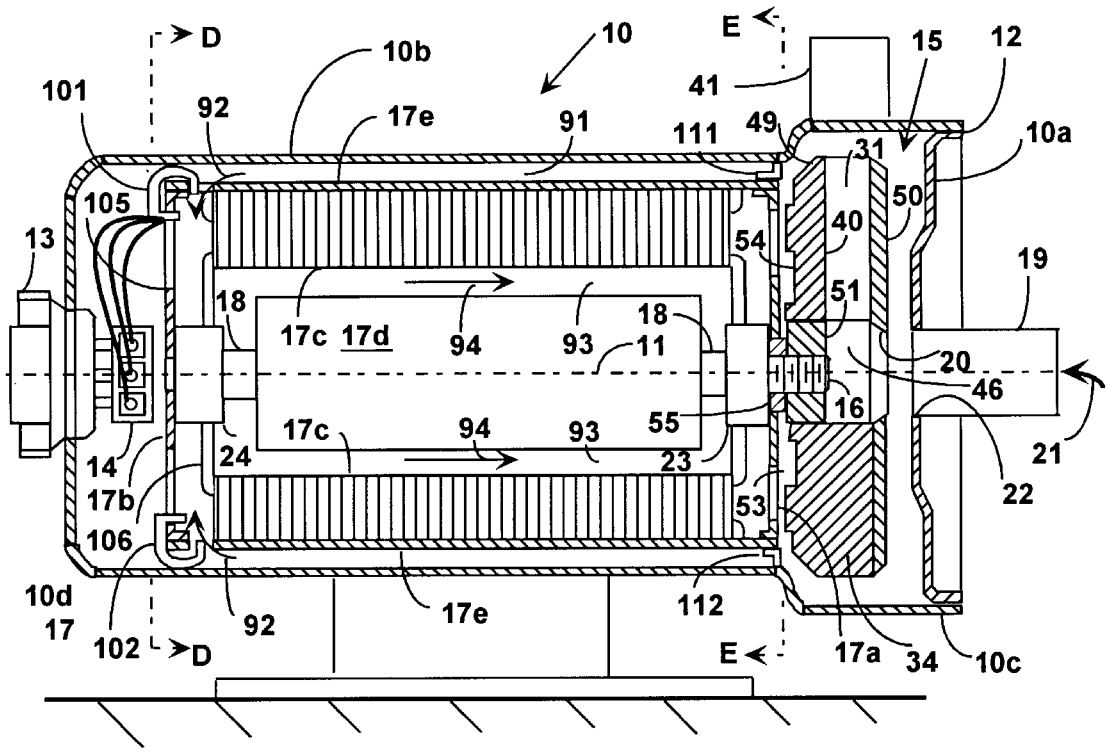
FIG. 8 is a detailed side cross section view of said electric motor driven centrifugal fluid pump according to the present invention in which the pump rotor and the electric motor are totally contained within the sealed housing which is penetrated only by the fluid input, the fluid output and the electric powerleads to the motor.
Figure 10:
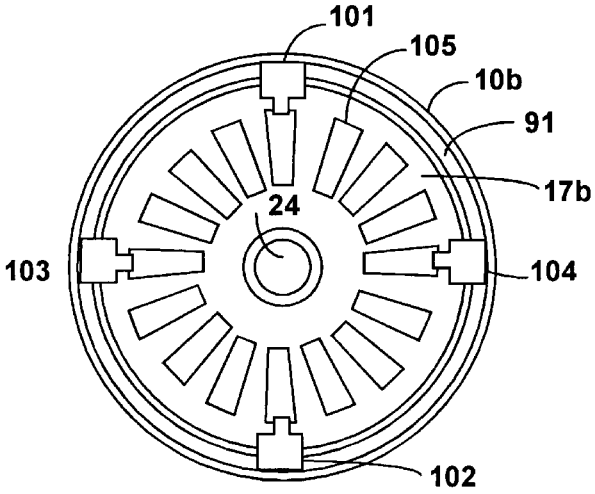
FIG. 10 is a rear end view of the motor showing the motor rear plate having openings for motor cooling fluid flow therethrough, the rear bearing and spring clips attached to the motor for spacing the motor from the inside of the sealed housing.
Figure 9:
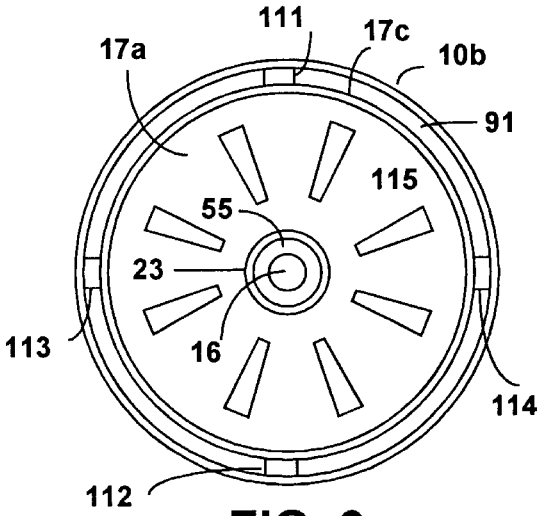
FIG. 9 is a front end view of the motor showing the motor front plate having openings for motor cooling fluid flow therethrough, the drive shaft opening therethrough, the front bearing and attachment of the front of the motor to the inside of the sealed housing.

Turning now to FIGS. 8 to 10, which show details of the submersible motor in the assembly and FIGS. 4 to 7, which show details of the pump rotor. There is embedded in the rotor base 49 at the center thereof hex nut 51 having threads 52 to accommodate the threaded end 46 of the motor drive shaft 16, enabling attachment of the pump rotor to the motor drive shaft. The motor drive shaft is a rigid extension of the motor axle 18 which is carried by front and rear motor bearings 23 and 24, which are attached to the motor front and rear plates 17*a* and 17*b*, respectively, which are welded to the motor cylindrical casing 17*e*. This attachment is done with suitable spacers 55 to provide a predetermined gap 53 between the rear face 54 of the pump rotor base 49 and the front face of the motor front plate 17*a*. The purposes of this gap are to provide suitable clearance between the rotating pump rotor and the stationery front face of plate 17*a* of the motor and to define radial passages for centrifugal pumping of motor cooling fluid between the motor and pump rotor.

Mounting The Motor-Pump Assembly In The Housing

Motor 17 is loaded into housing 10 after completing electrical connections at 14 and the pump rotor 15 is screwed onto the threaded end 16 of the motor drive shaft and when all is secured, the housing front plate 10*a* is positioned in the housing cylinder 10*c* and welded at 12.

The motor is inserted into the housing with four spring spacers 101 to 104 evenly spaced around the rear of the motor casing. The spring spacers insure that annular space 91 between the motor casing 17*e* and the housing cylinder 10*b* is uniform. They are attached to the motor rear plate 17*b* and cylinder 17*e* by tabs thereof that insert into regularly spaced openings, such as 105, in plate 17*b* and openings, such as 106, in cylindrical casing 17*e*.

When these spring spacers are so attached, they are secure to the motor and when the motor is inserted into the housing, the springs flex slightly evenly so that the motor can be forcibly inserted into the housing and annular space 91 is maintained even around the motor casing.

At the front of the motor casing are four front spacers 111 to 114 that maintain the annular spacing 91 at the front. These four spacers may be attached by welding to the motor casing before the motor is inserted into the housing. The motor casing front plate 17*a* contains several radial openings, such as 115, which allow fluid flow therethrough into the gap 53.

When the motor is positioned satisfactorily and fully inserted into the housing, the front spacers are welded to the inside of the housing. Then the pump rotor is attached with proper spacing to provide the desired gap 53 and the front plate 10*a* of the housing is positioned and welded in place sealing the assembly inside the housing except for the input tube 19 and the output tube 41.

Motor Cooling Fluid Pump

As shown in FIGS. 7 and 8, the motor cooling centrifugal pump 70 is provided by impeller vanis is ridges 71 to 76 on the rear face of the pump rotor base 49. These ridges with face 54 and the front face of the motor front plate 17*a* define radial fluid passages 81 to 86 (see FIG. 7) through which fluid is compelled to flow outward against the front face of plate 17*a* of the motor and then axially through the annular space 91, rearward, between the motor casing 17*e* and the inside wall of housing cylinder 10*b* as indicated by single line cooling fluied flow arrow 92.

The cooling fluid flow indicated by arrow 92 is from the front of the motor to the rear and, as mentioned, is compelled by motor cooling pump 70. This flow returns through annular space 93 between the motor stator 17*c* and the motor rotor 17*d* and is indicated by single line cooling fluid flow arrow 94. This return flow of motor cooling fluid is forward to the gap 53 between the front face of motor plate 17*a* and the rear face 54 of the pump rotor base 49. At the gap 53, this return cooling fluid flow flows into the radial fluid passages 81 to 86. The raised disc shaped part 95 accommodates the embedded hex nut 51 so that the inside face of the nut is flush with the inside face of the pump rotor base (see FIG. 7).

Motor Bearing Thrust Load Reduction

The forced flow of the fluid through the motor at constant motor speed is a constant circulation flow as described hereinabove and carries heat from the motor. The cooling fluid is at higher total pressure than fluid at the input to the pump in input tube 19 and is at about the same total pressure as the fluid at the output of the pump in output tube 41. Without the pumping action of 70, there would not be this circulation around the motor through passages 91 and 93 and so the static pressure against rotor face 54 would be the same as the total pressure of the fluid in space 53 between the motor front plate 17*a* and the rotor face 54. As a consequence, the thrust load on the motor bearings would be greatest. For example, for a submersible ½ HP motor-pump assembly pumping oil at 3 to 4 gpm to a head of 40 to 50 feet that thrust load has been observed to be as high as 27 pounds. The effect of the motor cooling flow pumping action reduces the static pressure in space 53 so that the thrust load is reduced by more than half.

Operation And Use

In operation, the motor 17 is energized through electric connector 13 driving clockwise or counterclockwise and rotating the pump rotor 15 the same. As a rotor starts up rotation, fluid within the covered main radial passages 61 to 66 immediately rotates with the rotor and is compelled by centrifugal force to flow to annular pump space 39 and out of fluid output port 41 to a utilization device or system (not shown). The utilization system has a sealed fluid flow system through which the pump fluid flows and returns to the fluid input 19 this, the pump output 41, the utilization system, the pump input 23 and the sealed housing 10 are entirely filled with the fluid during operation.

The best known use of the motor-pump assembly described herein has been to pump cooling oil to computerized axial tomography type of diagnostic x-ray scan equipment (CAT SCAN) to carry heat. away from the equipment and dissipate the heat in a liquid-to-air heat exchanger. In that use, the requirement for reliability of the motor-pump assembly is very high.

The Pump Rotor Structure

The pump rotor including features according to the present invention can be made of two unitary pieces: one piece including the base 49 with impeller vanes 31 to 36 on the inside of face 40 the motor cooling flow impeller ridges 71 to 76 and disc shaped central raised part 95 on the rear face 54; and the other unitary piece being the cover plate 50 with central input flow opening 20 These two unitary pieces may be made by casting, machining or molding. The material these pieces are made of determines the manner of attachment together. For example, if they are made of metal they can be welded or brazed together; if made of a polymer, they may be attached by epoxy resin.

The hex nut 51 is embedded in base 49 by fitting it to an accommodating hole formed in the base an fixedly attaching by force fitting, welding or by an epoxy resin.

The rotor is preferably made of class fiber filled lexan and all parts are molded. The thermal expansion coefficient of this material is only a little greater than aluminum, which is the preferred material for the hex nut 51 that is embedded in the rotor. Thus, thermal expansion of the rotor will not leave the nut loose in the base of the rotor as would happen with other plastic materials (such as plain lexan) that have a considerably higher coefficient of thermal expansion.

The principal feature of the present invention is that the rotor of the centrifugal pump and the electric drive motor are totally contained in a sealed housing as part of a sealed fluid flow system and the pump rotor has pumping means carried on the motor side thereof for pumping cooling fluid to the motor parts to cool them. An additional benefit of this structure is that the pumping action of cooling fluid to the motor also reduces the thrust load on the motor.

What is claimed is set forth in claims:

1. A motor driven centrifugal fluid pump comprising, (a) a pump rotor, (b) a pump drive motor having a front and a back and a motor drive shaft at said motor front defining an axis of rotation, (c) a sealed housing enclosing said rotor and said drive motor, (d) a fluid input to said housing from an outside source, (e) a fluid output from said housing to an outside utilization system, (f) said pump rotor being carried on said motor drive shaft so that said rotor rotates within said housing when driven by said motor drive shaft and pumps said fluid from said fluid input to said fluid output, (g) means carried on said motor drive shaft for compelling some of said fluid inside said housing to flow in heat conducting proximity to said motor to cool said motor and (h) means for feeding said fluid that cools said motor to said fluid output including:

(i) a first cooling fluid flow passage from said motor front to said motor back, (j) a second cooling fluid flow passage from said motor back to said motor front and (k) said fluid compelled to flow in heat conducting proximity to said motor flows from said motor front through said first passage to said motor back and from said motor back through said second passage to said fluid output.

2. A pump as in claim 1 wherein said means carried on said motor drive shaft for compelling some of said fluid inside said housing to flow in heat conducting proximity to said motor to cool said motor includes:

(a) motor cooling fluid pumping vanes or ridges that project axially toward said motor and define motor cooling fluid flow paths along which said motor cooling fluid is compelled to flow radially away from said axis of rotation.

3. A pump as in claim 2 wherein, (a) said motor cooling fluid flow paths along which said motor cooling fluid is compelled to flow radially away from said axis of rotation are further defined by said motor front.

4. A pump as in claim 3 wherein, (a) said motor cooling fluid pumping vanes or ridges are carried on said pump rotor and (b) said motor cooling fluid flow paths along which said motor cooling fluid is compelled to flow away from said axis of rotation are further defined by said pump rotor.

5. A pump as in claim 4 wherein said pump rotor includes:

(a) a disc shaped pump rotor base fixedly attached to said motor drive shaft, coaxial with said drive shaft axis of rotation, (b) said pump rotor base having a front face that faces away from said motor front end and a rear face that faces said motor front end, (c) main radially oriented vanes on said base front face for compelling said fluid to flow from said fluid input to said fluid output and (d) said motor cooling fluid pumping vanes or ridges are carried on said base rear face.

6. A pump as in claim 5 wherein, (a) said motor cooling fluid flow paths along which said motor cooling fluid is compelled to flow away from said axis of rotation are further defined by said pump rotor base rear face.

7. A pump as in claim 6 wherein, (a) said main radially orientated vanes project axially from said base front face and define main radial input to output fluid flow paths and compel said fluid flow therethrough from said fluid input to said fluid output when said rotor is driven in rotation.

8. A pump as in claim 7 wherein, (a) said main radial input to output fluid flow paths are further defined by said pump rotor base front face.

9. A pump as in claim 8 wherein, (a) means are provided attached to the axially projecting ends of said main radially orientated vanes that project axially from said base front face for further defining said radial input to output fluid flow paths.

10. A pump as in claim 9 wherein, (a) said means attached to said axially projecting ends of said main vanes is a cover plate having an input fluid flow opening at the center thereof coaxial with said motor drive shaft axis, (b) said pump fluid input is located in said sealed housing along said axis and (c) said pump fluid output is located in said sealed housing at the periphery of said pump rotor.

11. An electric motor driven centrifugal fluid pump comprising, (a) a pump rotor, (b) a pump electric drive motor having a front and a back and a motor drive shaft at said motor front defining an axis of rotation, (c) a sealed housing enclosing said rotor and said electric drive motor, (d) a fluid input to said housing from an outside source, (e) a fluid output from said housing to an outside utilization system, (f) an electrical connector sealed to said housing providing electric power conductors to said electric motor inside said housing from outside said housing, (g) said pump rotor being carried on said motor drive shaft so that said rotor rotates within said housing when driven by said motor drive shaft and pumps said fluid from said fluid input to said fluid output, (h) means carried on said motor drive shaft for compelling some of said fluid inside said housing to flow in heat conducting proximity to said motor to cool said motor and (i) means for feeding said fluid that cools said motor to said fluid output fluid output including:

(j) a first cooling fluid flow passage from said motor front to said motor back, (k) a second cooling fluid flow passage from said motor back to said motor front and (l) said fluid compelled to flow in heat conducting proximity to said motor flows from said motor front through said first passage to said motor back and from said motor back through said second passage to said fluid output.

12. A pump as in claim 11 wherein said means carried on said motor drive shaft for compelling some of said fluid inside said housing to flow in heat conducting proximity to said motor to cool said motor includes:

(a) motor cooling fluid pumping vanes or ridges that project axially toward said motor and define radial motor cooling fluid flow paths along which said motor cooling fluid is compelled to flow radially away from said axis of rotation.

13. A pump as in claim 12 wherein, (a) said motor cooling fluid flow paths along which said motor cooling fluid is compelled to flow radially away from said axis of rotation are further defined by said motor front.

14. A pump as in claim 13 wherein, (a) said motor cooling fluid pumping vanes or ridges are carried on said pump rotor and (b) said motor cooling fluid flow paths along which said motor cooling fluid is compelled to flow away from said axis of rotation are further defined by said pump rotor.

15. A pump as in claim 14 wherein said pump rotor includes:

(a) a disc shaped pump rotor base fixedly attached to said motor drive shaft, coaxial with said drive shaft axis of rotation, (b) said pump rotor base having a front face that faces away from said motor front end and a rear face that faces said motor front end, (c) main radially oriented vanes on said base front face for compelling said fluid to flow from said fluid input to said fluid output and (d) said motor cooling fluid pumping vanes or ridges are carried on said base rear face.

16. A pump as in claim 15 wherein, (a) said motor cooling fluid flow paths along which said motor cooling fluid is compelled to flow away from said axis of rotation are further defined by said pump rotor base rear face.

17. A pump as in claim 16 wherein, (a) said main radially orientated vanes project axially from said base front face and define main radial input to output fluid flow paths and compel said fluid flow therethrough from said fluid input to said fluid output when said rotor is driven in rotation.

18. A pump as in claim 17 wherein, (a) said main radial input to output fluid flow paths are further defined by said pump rotor base front face.

19. A pump as in claim 18 wherein, (a) means are provided attached to the axially projecting ends of said main radially orientated vanes that project axially from said base front face for further defining said radial input to output fluid flow paths.

20. A pump as in claim 19 wherein, (a) said means attached to said axially projecting ends of said main vanes is a cover plate having an input fluid flow opening at the center thereof coaxial with said motor drive shaft axis, (b) said pump fluid input is located in said sealed housing along said axis and (c) said pump fluid output is located in said sealed housing at the periphery of said pump rotor.

* * * * *